United States Patent [19]

McKean

[11] Patent Number: 5,044,880

[45] Date of Patent: Sep. 3, 1991

[54] VARIABLE GEOMETRY TURBINE ACTUATOR ASSEMBLY

[75] Inventor: Peter McKean, Marsh, United Kingdom

[73] Assignee: Holset Engineering Company Limited, United Kingdom

[21] Appl. No.: 353,763

[22] Filed: May 16, 1989

[30] Foreign Application Priority Data

May 17, 1988 [GB] United Kingdom ..... 8811624

[51] Int. Cl.[5] ..... F04D 29/56; F04D 27/00

[52] U.S. Cl. ..... 415/158

[58] Field of Search ..... 415/148, 150, 151, 155, 415/156, 157, 165, 158; 74/110, 572, 573 F, 104

[56] References Cited

U.S. PATENT DOCUMENTS

| | | | |
|---|---|---|---|
| 1,023,855 | 4/1912 | King et al. | 74/104 |
| 1,243,586 | 10/1917 | Brown | 74/110 |
| 3,079,127 | 2/1963 | Kowlett et al. | 415/150 |
| 4,544,325 | 10/1985 | Rogo et al. | 415/150 |

FOREIGN PATENT DOCUMENTS

| | | | |
|---|---|---|---|
| 0095853 | 7/1983 | European Pat. Off. . | |
| 1913048 | 2/1970 | Fed. Rep. of Germany . | |
| 0131104 | 10/1979 | Japan | 415/157 |
| 0034973 | 4/1981 | Japan | 415/150 |
| 8603809 | 7/1986 | PCT Int'l Appl. | 415/148 |

*Primary Examiner*—Edward K. Look
*Assistant Examiner*—Hoang Nguyen
*Attorney, Agent, or Firm*—Pravel, Gambrell, Hewitt, Kimball & Krieger

[57] ABSTRACT

An actuator assembly for a variable geometry turbine in which an inlet passageway to the turbine is defined between a movable annular wall member and a facing wall, the position of the movable annular wall member being adjustable to control the width of the inlet passageway. The annular wall member is supported on a pair of pins which extend parallel to and are slidable parallel to the axis of the rotation of the turbine wheel. Each pin is engaged by a respective arm of a pivotally mounted stirrup the angular position of which is controlled by an actuator. The engagement between the pins and the stirrup is such that pivotal movement of the stirrup causes axial movement of the pin.

5 Claims, 6 Drawing Sheets

VARIABLE GEOMETRY TURBINE ACTUATOR ASSEMBLY

This application is based upon British Patent Application No. 88 11624, filed May 17, 1988.

FIELD OF THE INVENTION

The present invention relates to a variable geometry turbine actuator assembly and in particular to such a turbine suitable for use in association with a turbine for an internal combustion engine.

BACKGROUND

Turbines generally comprise a turbine wheel mounted in a turbine chamber, an annular inlet passageway arranged around the turbine chamber, an inlet chamber arranged around the inlet passageway and an outlet passageway extending from the turbine chamber. The passageways and chambers communicate such that pressurized gas admitted to the inlet chamber flows through the inlet passageway to the outlet passageway via the turbine chamber, thereby driving the turbine wheel. In a variable geometry turbine, one wall of the inlet passageway is defined by a movable annular wall member the position of which is adjustable, relative to a facing wall of the inlet passageway, to control the width of the inlet passageway.

One known variable geometry turbine arrangement is described in European Patent Specification EP-A-0080810. In the described arrangement therein, a thin walled annular wall member is supported on a pair of guide pins which extend parallel to and are slidable parallel to the axis of rotation of the turbine wheel. Each pin is acted upon by a respective actuator. Such an arrangement raises various problems in terms of ease of manufacture and reliability. With regard to ease of manufacture, the actuators must be accommodated in the limited space around and close to the axis of the turbine, and this is a real constraint upon the turbine design. With regard to reliability, the structure is exposed to considerable temperature gradients which can lead to jamming of the pins if they are subjected to transverse stress. Doubts as to long term reliability have been a major factor in holding back the introduction of variable geometry turbines.

SUMMARY OF THE INVENTION

It is an object of the present invention to provide a variable geometry turbine which obviates or mitigates the problems outlined above.

According to the present invention there is provided an actuator assembly for a variable geometry turbine comprising an annular inlet passageway, one wall of which is defined by a movable annular wall member the position of which is adjustable relative to a facing wall of the inlet passageway, to control the width of the inlet passageway, the annular wall member being supported on a pair of pins which extend parallel to and are slidable parallel to the axis of rotation of the turbine wheel. Each pin is engaged by a respective arm of a pivotally mounted stirrup the angular position of which is controlled by a single actuator, the engagement between the pins and the stirrup being such that pivotal movement of the stirrup causes axial movement of the pins.

Preferably each pin has a slot intermediate its ends, and the end of the respective arm of the stirrup engages in the slot.

Preferably the end of the stirrup which engages in the slot has an arcuate surface which bears against the edges of the slot.

Preferably the stirrup is of sheet metal, and each stirrup arm is arranged such that the plane defined by the sheet from which it is formed extends parallel to the axis of rotation of the turbine wheel.

DETAILED DESCRIPTION OF THE INVENTION

Figure 1:
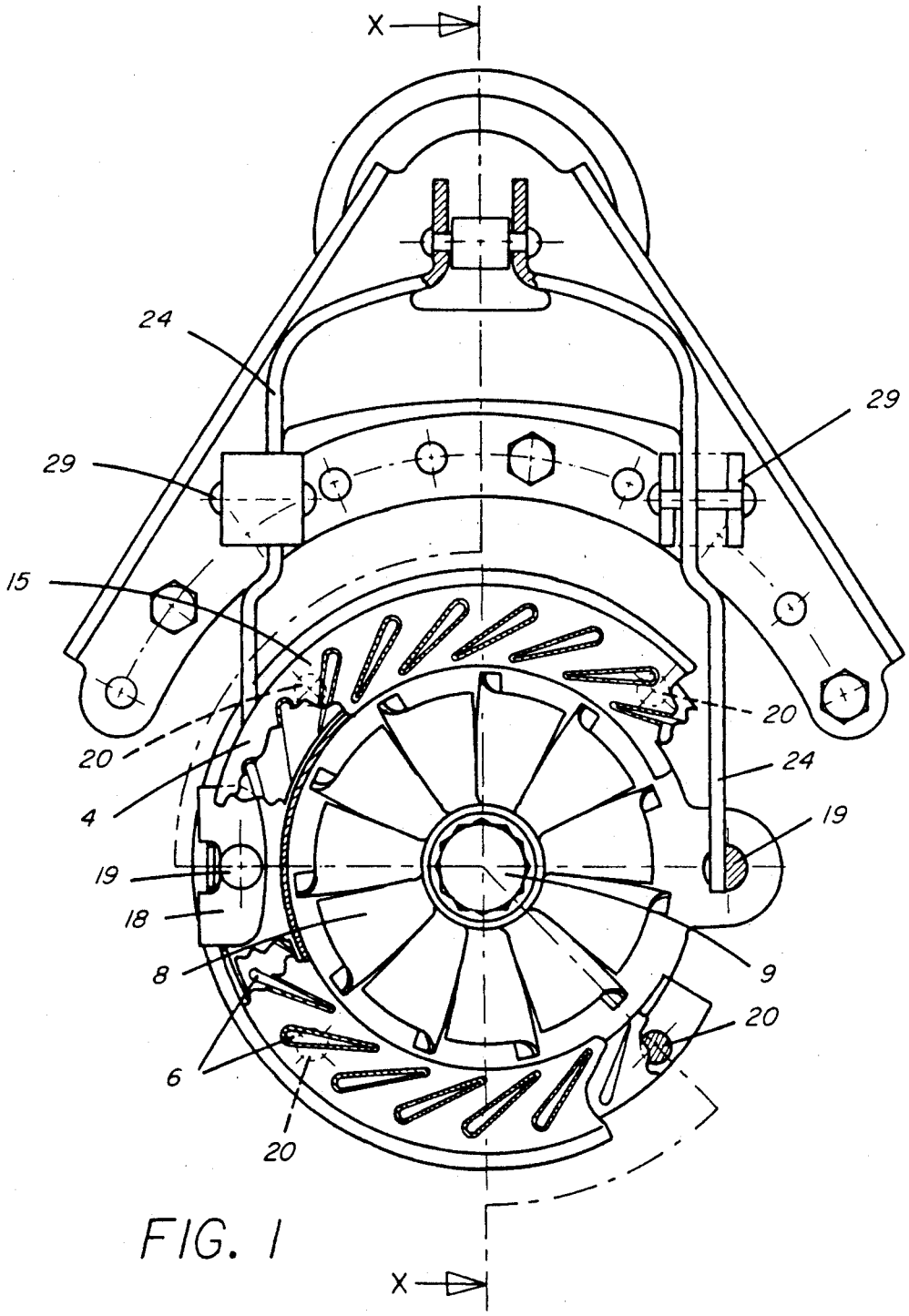
FIG. 1 is a cut-away view looking along the axis of a variable geometry turbine in accordance with the present invention, the view showing axially spaced features of the turbine.

Referring now to FIGS. 1 to 4, the illustrated variable geometry turbine comprises a turbine housing 1 defining a volute or inlet chamber 2 to which exhaust gas from an internal combustion engine (not shown) is delivered. The exhaust gas flows from the inlet chamber 2 to an outlet passageway 3 via an inlet passageway 33 defined on one side by a movable annular member 4 and on the other side by a wall 5 which faces the movable annular wall member 4. An array of nozzle vanes 6 supported on a nozzle support ring 7 extends across the inlet passageway 33. Gas flowing from the inlet chamber 2 to the outlet passageway 3 passes over a turbine wheel 8 and as a result a torque is applied to a turbocharger shaft 9 which drives a compressor wheel 10. Rotation of the wheel 10 pressurizes ambient air present in an air inlet 11 and delivers the pressurized air to an air outlet or volute 12. That pressurized air is fed to the internal combustion engine (not shown).

The movable annular wall member 4 is contacted by a sealing ring 13 and comprises a radially inner tubular wall 14, a radially extending annular portion 15 which defines slots through which the vanes 6 extend, a radially outer tubular portion 16 which bears against the sealing ring 13, and a radially extending flange 17. The radially outer tubular portion 16 is engaged by two diametrically opposed bridge link plates 18 which are supported on respective guide pins 19.

The nozzle support 7 is mounted on an array of four guide pins 20 so as to be movable parallel to the axis of rotation of the turbocharger. Each of the guide pins 20 is biased by a compression spring 21 towards the right in FIGS. 2 to 4. Thus the nozzle support 7 and the vanes mounted on it are biased towards the right in FIGS. 2 to 4 and accordingly normally assume the position shown in FIG. 2, with the free ends of the vanes 6 bearing against the facing wall 5 of the inlet passageway 33.

Figure 2:
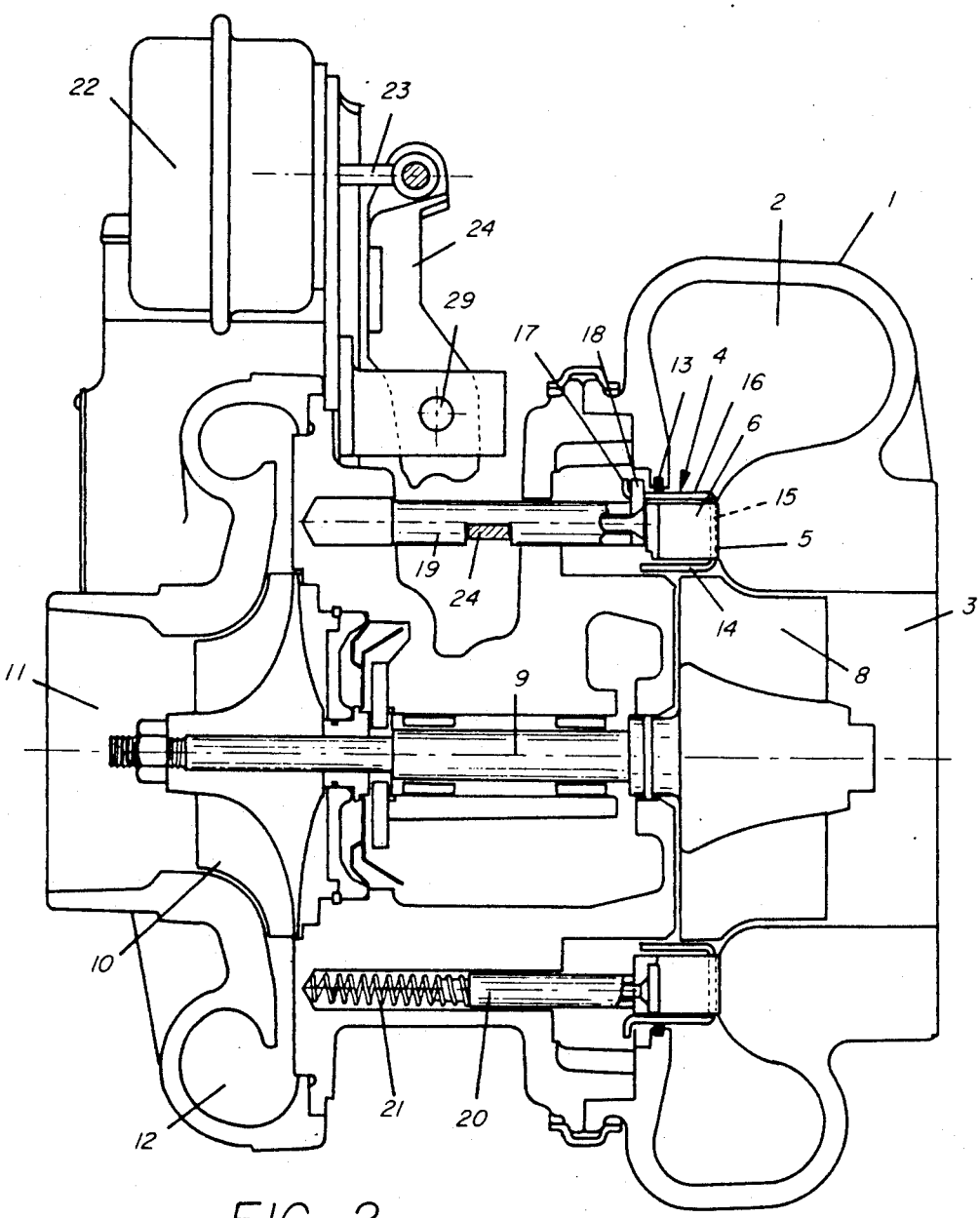
FIGS. 2, 3 and 4 are sectional views taken on the line X—X of FIG. 1 with components of the assembly of FIG. 1 shown respectively in the fully closed (FIG. 2), half closed (FIG. 3) and fully open (FIG. 4) positions.
Figure 3:
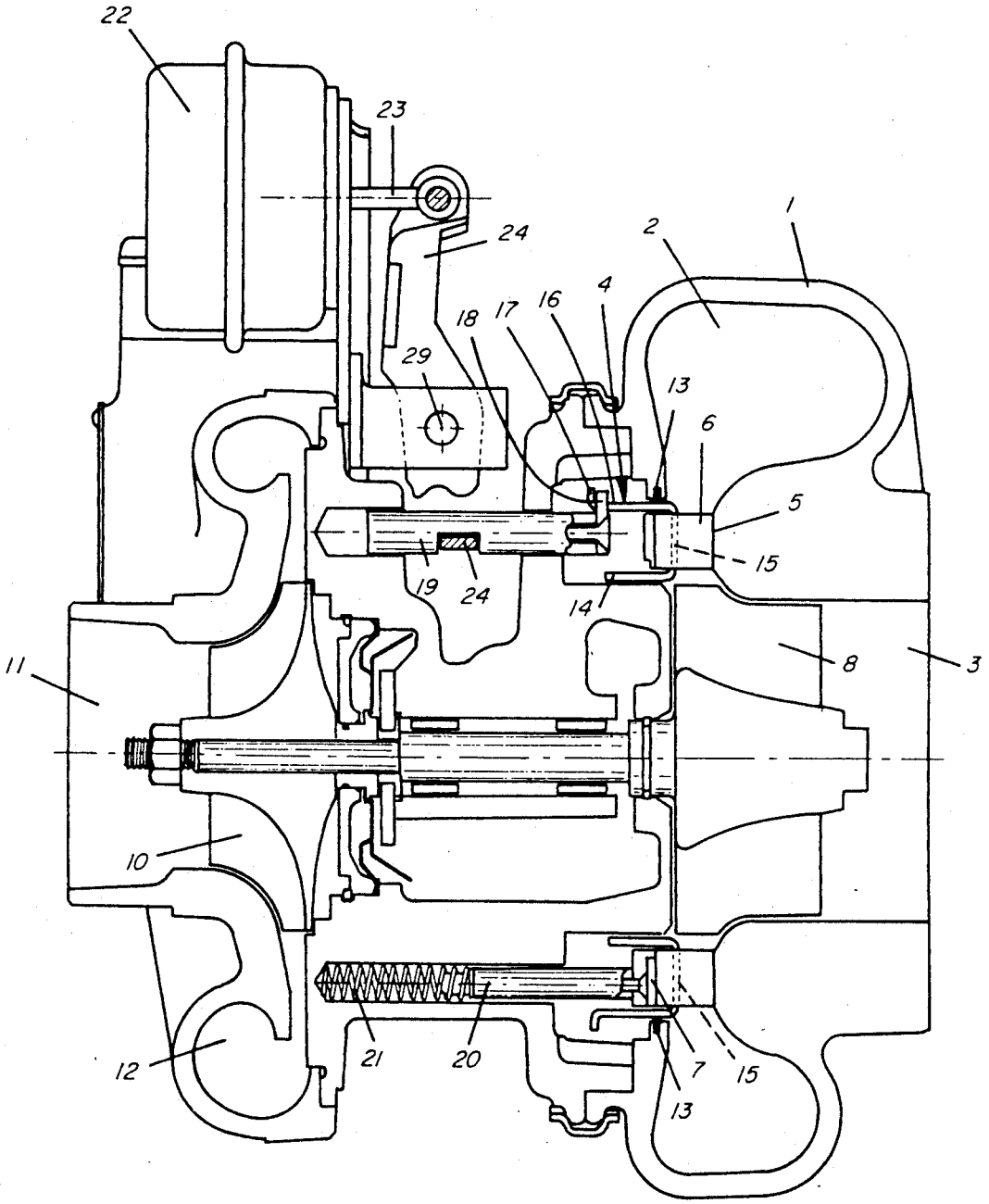
Figure 4:
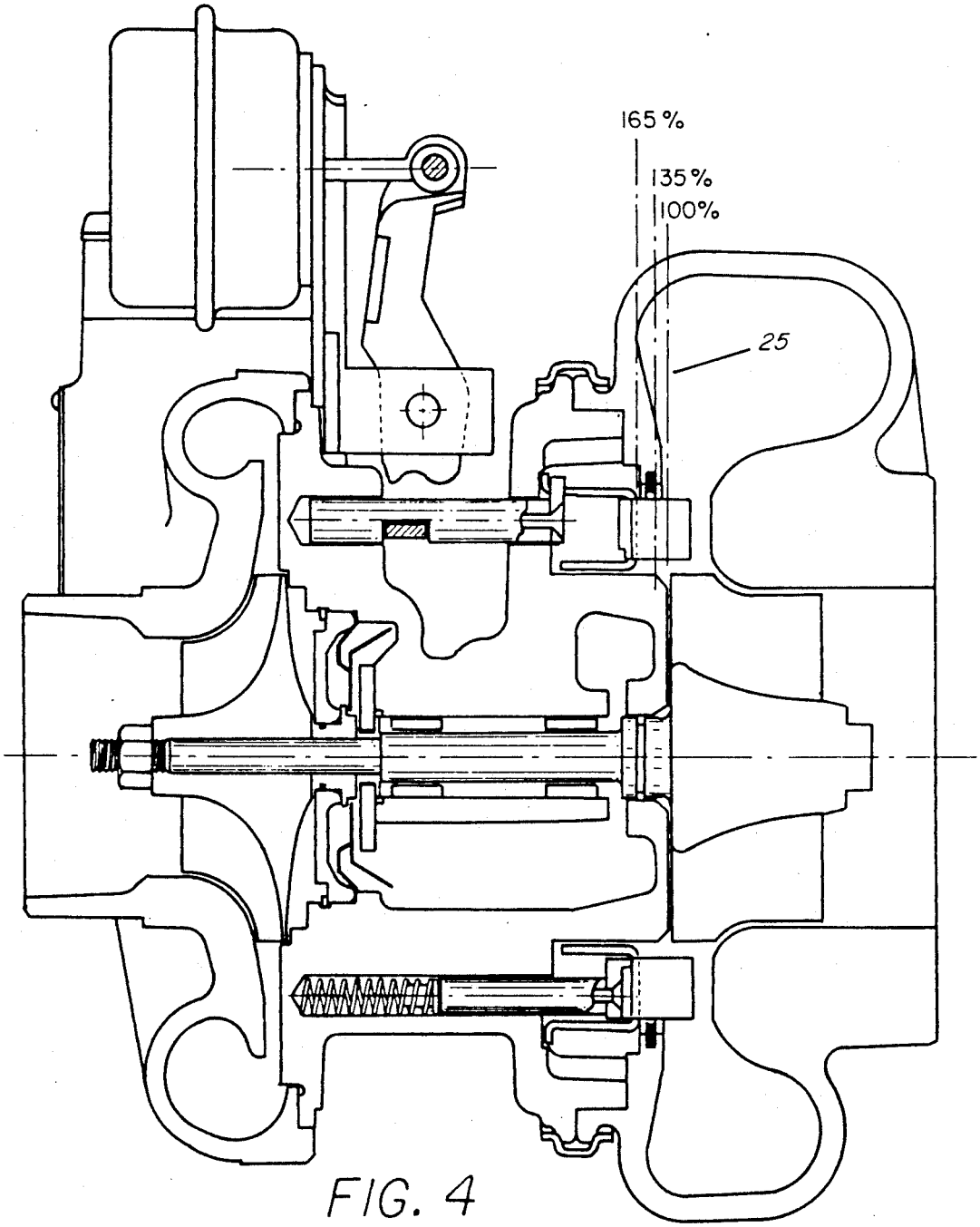

A pneumatically operated actuator 22 is operable to control the position of an actuator output shaft 23 that is linked to a stirrup member 24 that engages each of the guide pins 19. Thus by controlling the actuator 22 the axial position of the guide pins 19 and thus of the movable annular wall member 4 can be controlled. FIG. 2 shows the movable annular wall member 4 in its fully closed position in which the radially extending portion 15 of the member abuts the facing wall 5 of the inlet passageway 33. FIG. 3 shows the annular wall member 4 in a half open position and FIG. 4 shows the annular wall member 4 in a fully open position. As the actuator 22 is positioned at a considerable distance from the turbine axis, space is not a problem. Furthermore, the precise radial position of the actuator output shaft 23 is not critical, allowing tolerances to be increased. In addition, radial expansion due to thermal distortion is not a critical problem.

Referring to FIG. 4, a dotted line indicates an imaginary surface 25 which is coplanar with the end surface of the turbine housing 1, the downstream side of the movable member 4, and adjacent which the turbine wheel 8 is positioned. This surface in effect defines one side of the inlet passageway 33 to the turbine chamber. When the wall of the inlet passageway 33 defined by the movable annular wall member 4 is aligned with the imaginary surface 25 the spacing between the annular wall member 4 and the facing wall 5 is for the purposes of the present description deemed to correspond to the inlet width of the inlet passageway 33 downstream of the vanes 6. This condition is referred to below as 100% of nominal inlet width. When the movable annular wall member 4 is in the "100% of nominal inlet width" position the vanes 7 are still in contact with the facing wall 5. As the annular wall member 4 moves further away from the facing wall 5 the gap between the rear face of the annular wall member 4 and the nozzle support 7 is reduced until the two come into contact. This occurs when the spacing between the annular wall member 4 and the facing surface 5 corresponds to 135% of the nominal inlet passageway inlet width. Further movement of the annular wall member 4 away from the facing wall 5 results in the nozzle support 7 moving with the annular wall member 4. Accordingly, the free ends of the vanes 6 are pulled back from the facing wall 5 and a gap therefore develops in the inlet passageway 33 between the free ends of the vanes and the facing wall. This increases the effective area of the inlet passageway 33. When the annular wall member 4 is fully retracted (FIG. 4) its position corresponds to 165% of the nominal inlet passageway width.

Figure 5:
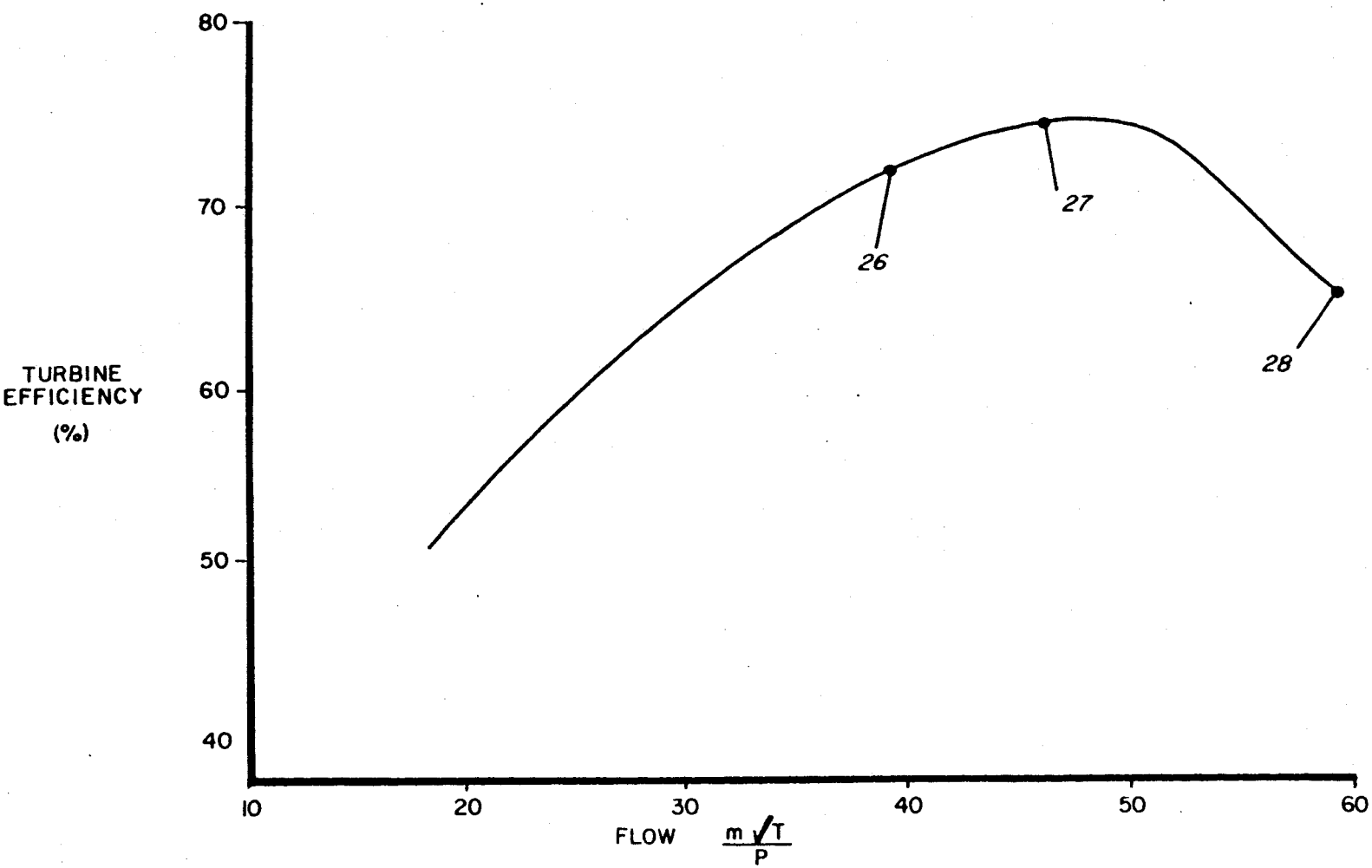
FIG. 5 is a graph showing the relationship between turbine efficiency and mass flow through the turbine of FIG. 1, at a constant expansion ratio.

Referring now to FIG. 5, this illustrates the effect on turbine efficiency of movements of the annular wall member 4 and the nozzle support 7. The point on the curve corresponding to 100% of nominal inlet width is indicated by numeral 26. The points on the curve corresponding to 135% opening and 165% opening are indicated by numerals 27 and 28 respectively. Thus it can be seen that by providing for the annular wall member 4 to open well beyond the nominal 100% position and by providing for partial retraction at least of the nozzle vanes the operational characteristics of the turbine can be modified to increase the proportion of those operating characteristics which lie within a high efficiency region of the performance curve. Essentially, for a given flow range (corresponding to a fixed distance parallel to the flow axis) the ability to extend the characteristic curve to point 28 increases the mean turbine efficiency by avoiding operating the turbine in the less efficient region indicated by the left-hand end of the curve in FIG. 5.

Figure 6:
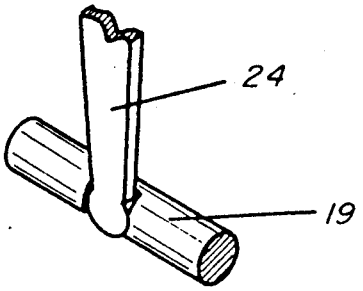
FIG. 6 is a perspective view of guide pins supporting a movable wall member of the apparatus of FIGS. 1 to 4 and a stirrup member which controls the position of those guide pins.

Referring now to FIG. 6, this shows the interengagement between the stirrup 24 and one of the guide pins 19 upon which the movable annular wall member 4 is mounted. The two ends of the stirrup 24 engage in slots cut in side surfaces of pins 19. The edges of the stirrup ends which bear against the ends of the slots are curved so that the clearance between each stirrup end and the slot ends is constant. The stirrup 24 is pivoted on pivot pins 29 so that the stirrup 24 forms a lever which can be moved to precisely position the pins 19. The stirrup 24 is formed from sheet steel arranged such that the stirrup is relatively stiff in the direction parallel to the axis of pins 19 but relatively flexible perpendicular to the pins. Thus transverse forces on the pins 19 are minimized, thereby reducing the probability of the pins 19 jamming in the bearings within which they slide. Furthermore, as the stirrup 24 engages central portions of the pins 19 the bearings in which the pins 19 are mounted are relatively widely spaced.

Figure 7:
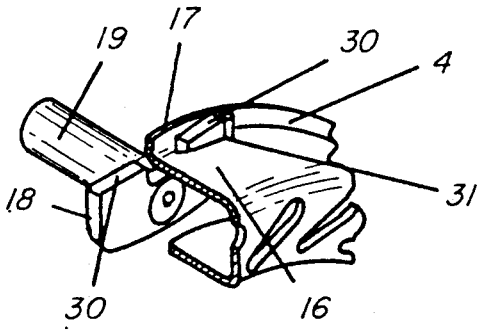
FIG. 7 is a perspective view of a guide pin of the type illustrated in FIG. 6 and a movable wall member.

FIG. 7 illustrates the interengagement between the guide pins 19 and the annular wall member 4. The member 4 is exposed to large variations in temperature and pressure and can accordingly distort to a certain degree. If the linkage between the member 4 and the pin 19 were rigid such distortion would apply significant transverse forces to the pins 19. Accordingly the engagement between the member 4 and pins 19 is such that distortion of the member 4 can be accommodated without applying transverse forces to the pin.

As shown in FIG. 7 this is achieved by rigidly mounting a bridge link plate 18 on the end of each pin 19. Two legs 30 of the bridge link 18 engage in slots 31 defined in the tubular portion 16 of the member 4 adjacent the flange 17. The result is a structure which is adequately rigid in the direction of the axis of the pins 19 to ensure close control of the axial position of the member 4 but which is sufficiently loose in the radial and circumferential directions to accommodate thermal distortions of the member 4. The member 4 is in effect located on the vanes 6 and thus the member 4 is maintained in position despite its relatively loose mounting.

The bridge links 18 can be thicker than the flange 17 to maintain a stiff joint in the axial direction, and the width of the links 18 maintains a good resistance to tilting of the member 4 relative to the turbine axis.

Figure 8:
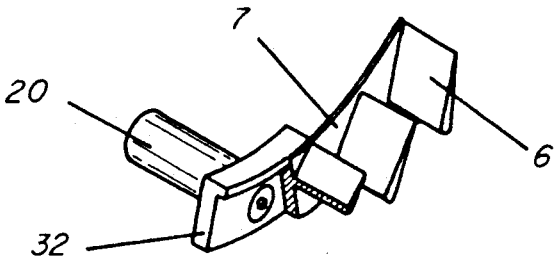
FIG. 8 is a perspective view of the mounting of a nozzle vane support ring incorporated in the arrangement of FIGS. 1 to 4.

Referring now to FIG. 8, this illustrates the interrelationship between the spring biased support pins 20 and the nozzle support 7 on which the vanes 6 are mounted. Each pin 20 has rigidly mounted on its end a bracket 32 which has a flat surface engaging the rear side of the nozzle support ring 7 and an inner edge which is flanged to engage inside the radially inner edge of the nozzle support ring 7.

The illustrated arrangement comprises a single annular seal 13 arranged around the radially outer side of the movable wall member 4. Alternative sealing arrangements are possible, however, for example a pair of seals arranged respectively on the radially inner and outer portions of the movable annular wall member 4.

It will also be appreciated that more than one actuator could be provided to control the position of the stirrup 24. For example, two actuators could be provided in a push/pull arrangement. Such an arrangement might be appropriate, for example, where a relatively large single actuator would occupy too much of the available radial space.

This description is intended to be illustrative of the invention only. Variations on this embodiment will be apparent to one skilled in the art. All variations are intended to be encompassed by the following claims.

I claim:

1. An actuator assembly for a variable geometry turbine comprising an annular inlet passageway, one wall of which is defined by a movable annular wall member the position of which relative to a facing wall of the inlet passageway is adjustable to control the width of the inlet passageway, the annular wall member having mounted thereon a single pair of pins which extend parallel to and are slidable parallel to the axis of rotation of the turbine wheel, wherein each pin is engaged by a respective arm of a single pivotally mounted stirrup the angular position of which is controlled by a single actuator, and wherein the engagement between the pins and the stirrup permits pivotal movement of the stirrup to cause axial movement of the pins.

2. An actuator assembly for a variable geometry turbine according to claim 1, wherein each pin includes a slot intermediate its ends and an end of the respective arm of the stirrup engages in the slot.

3. An actuator assembly for a variable geometry turbine according to claim 2, wherein the end of the respective arm of the stirrup which engages in the slot includes an arcuate surface which bears against edges of the slot.

4. An actuator assembly for a variable geometry turbine according to claim 1, 2 or 3, wherein the stirrup is fabricated from sheet metal and each stirrup arm is arranged such that a plane defined by a sheet from which the stirrup is formed extends parallel to the axis of rotation of the turbine wheel.

5. An actuator assembly for a variable geometry turbine according to claim 1, further comprising a pair of bridge link plates, each rigidly mounted to the end of each of said pins adjoining said movable annular wall element, and wherein said annular wall element is slotted to accommodate said bridge link plates.

* * * * *